United States Patent [19]

Draghicchio

[11] Patent Number: 4,641,591

[45] Date of Patent: Feb. 10, 1987

[54] ADJUSTABLE DRIVE SHAFT FOR MULTI-HEAD SEWING MACHINE

[75] Inventor: Pietro Draghicchio, Corsico, Italy

[73] Assignee: Rockwell-Rimoldi S.p.A., Italy

[21] Appl. No.: 807,926

[22] Filed: Dec. 12, 1985

[30] Foreign Application Priority Data

Apr. 30, 1985 [IT] Italy ..... 21675/85[U]

[51] Int. Cl.[4] ..... D05B 25/00; D05B 35/02

[52] U.S. Cl. ..... 112/155; 112/167; 112/168; 464/162

[58] Field of Search ..... 112/155, 168, 167, 121.14; 464/162

[56] References Cited

U.S. PATENT DOCUMENTS

| | | | |
|---|---|---|---|
| 2,072,090 | 3/1937 | Anderson | 464/162 |
| 2,249,423 | 7/1941 | Galkin | 112/155 |
| 3,073,135 | 1/1963 | Wood | 464/162 X |
| 3,468,273 | 9/1969 | Lester | 112/155 |
| 4,061,096 | 12/1977 | Elsas | 112/155 X |

*Primary Examiner*—Werner H. Schroeder
*Assistant Examiner*—Andrew M. Falik

[57] ABSTRACT

A sewing machine consisting of left and right hand individual sewing machines which are joined together adjustably to provide a gap between the machine bases in which drive means are provided that includes an external drive shaft that is joined at its ends to each of the individual machines.

6 Claims, 5 Drawing Figures

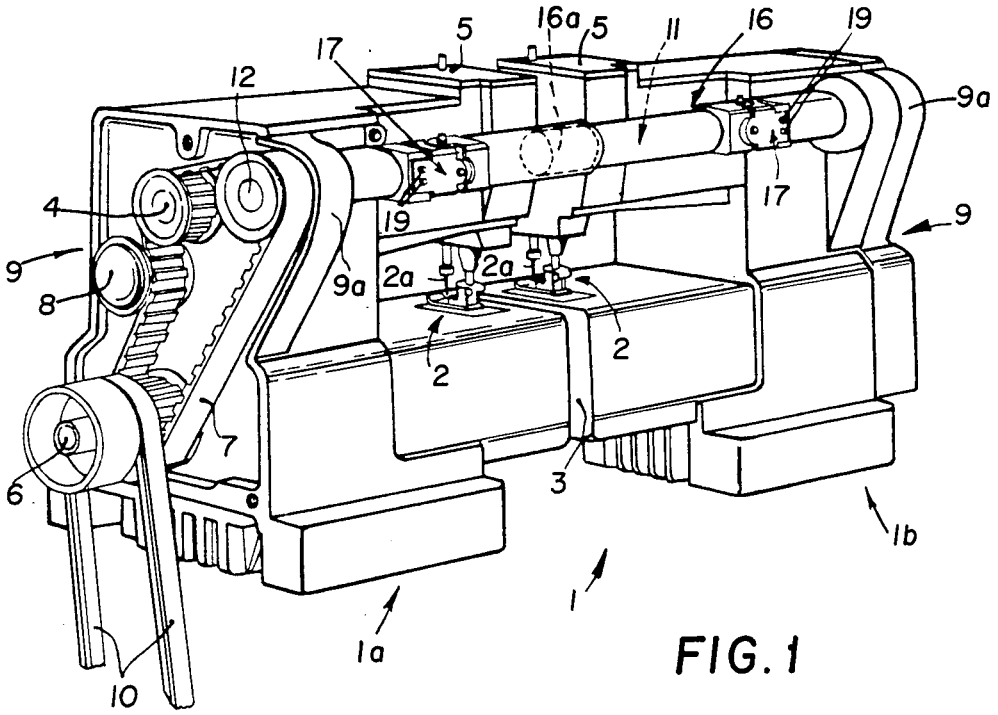
FIG. 1
FIG. 2
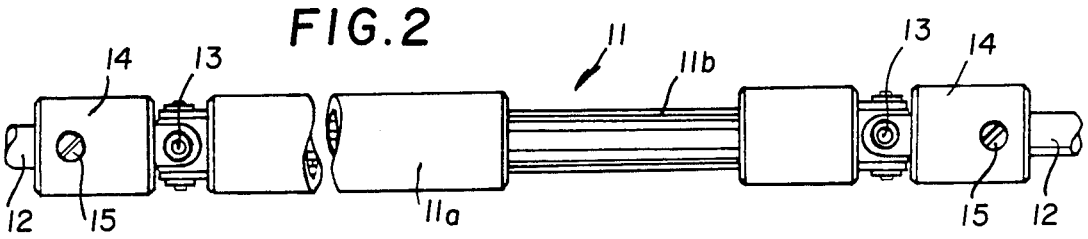
FIG. 3
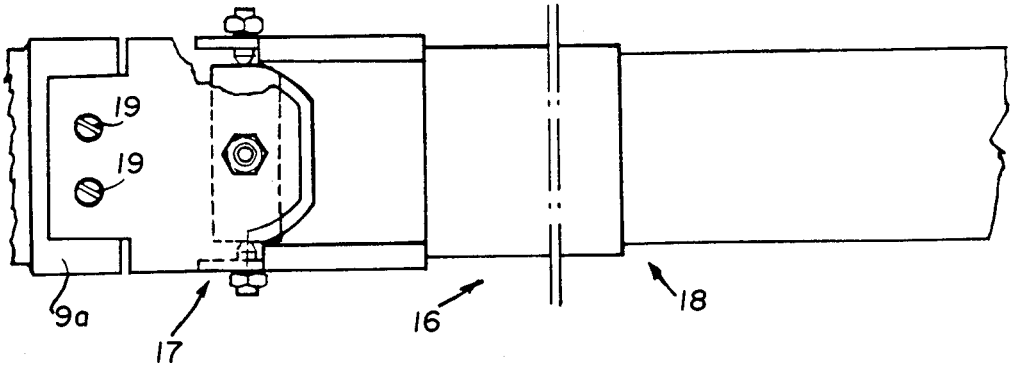

ADJUSTABLE DRIVE SHAFT FOR MULTI-HEAD SEWING MACHINE

BACKGROUND OF THE INVENTION

The present invention relates to a sewing machine designed to perform stitches simultaneously on the opposite edges of a semifinished article, in particular a sewing machine of the type with a gap between the needles where the article of clothing or similar obJect is arranged during sewing.

It is known from previous studies by the same applicant to design sewing machines which have a gap in the middle and which are able to sew the opposite edges of numerous articles of clothing in a single sewing operation.

The operation of these sewing machines is not restricted by the need for the two edges to be sewn to be parallel with each other; in fact, as a result of a process perfected by the same applicant, mere tensioning of the articles of clothing can lead to substantial straightening of the edges during sewing.

However, a significant problem connected with the sewing machines mentioned above is how to adjust the distance between the needles, since, in some cases, the two lines of stitches must be very close to each other, while, in other cases, they must be separated by a distance which is sufficient to allow even bulky articles of clothing to be inserted in the gap provided between the sewing components. The problem arises from the fact that, on the one hand, the various sewing components must be properly connected to each other whereas, on the other hand, the working surface of the machine described must be divided into two separate support plates so that arrangement of the said gap is made possible.

The same applicant has already perfected a sewing machine in which two separate support plates form the base of a bridge-type structure which accommodates an internal shaft connecting together the various sewing components. This internal connection shaft is in practice provided with a sleeve coupling which allows axial extension of the shaft itself in accordance with the distance between the two needles and the associated lower sewing components.

Practical tests have demonstrated the validity of the solution proposed by the applicant. However, it also became apparent that the entire bridge-type frame of the sewing machine in question must be designed with a very high degree of precision so that when the operations necessary for moving the sewing components away from each other or towards each other are performed, the two sections of the said connection shaft remain perfectly aligned with respect to each other. Even in the case of very precise and hence costly design of the bearing frame of the said machine, in many cases jamming of the connected parts or at least binding of the connection mechanisms occurred, thus giving rise to a great deal of wear and high levels of power consumption.

Another typical problem of these sewing machines consists in the fact that the said machines have a relatively high purchase price which in many cases is disproportionate compared to the requirements of small users. The latter always have the possibility of performing all the sewing operations using individual machines, i.e. of the right-hand or left-hand type, and there is therefore the tendency to buy machines with a bridge structure only when, in practice, work requirements call for use of the same.

In doing so, a large number of users in many cases decide to do without the rapidity and operational features which characterize the sewing machines described above.

SUMMARY OF THE INVENTION

In this situation, the general object of the present invention is to overcome the abovementioned drawbacks. Within the context of this general object, an important object of the present invention is to design a sewing machine which, while ensuring perfect synchronism between the various sewing components and allowing the said components to be moved fully and easily towards each other or away from each other, has a simple structure and operates in such a way that the kinematic chain linking together the sewing components is free from jamming or binding.

Another important object of the present invention is to design a sewing machine of the kind mentioned, which can be made available also for users who have relatively limited work requirements and production levels.

Yet another object of the present invention is to design a sewing machine which has a simple structure and can be easily obtained from conventionally manufactured sewing machines.

These objects and further objects which will appear more clearly below are substantially achieved by a sewing machine designed to perform stitches simultaneously on the opposite edges of a semifinished article, of the type with a gap between the sewing components where the article of clothing or similar object is arranged during sewing, consisting of two sewing machines located opposite and alongside each other, one of the right-hand type and the other of the left-hand type, one of which is operated by the other via an external drive shaft provided with a universal coupling at each end and a sleeve expansion coupling.

DESCRIPTION OF THE DRAWINGS

Advantageously, the said external drive shaft is mounted detachably on the said sewing machines. Further characteristic features and advantages will emerge more clearly from the description of a preferred, but not exclusive embodiment of a sewing machine of the type mentioned above and illustrated with reference to the attached drawings in which:

FIG. 1 is an overall perspective view of the machine according to the invention;

FIG. 2 shows, viewed from the side, the structure of a drive shaft of the machine according to the invention;

FIG. 3 shows, again viewed from the side and partially in section, part of protective sleeve for the drive shaft shown in FIG. 2;

DESCRIPTION OF THE PREFERRED EMBODIMENT

Figure 4:
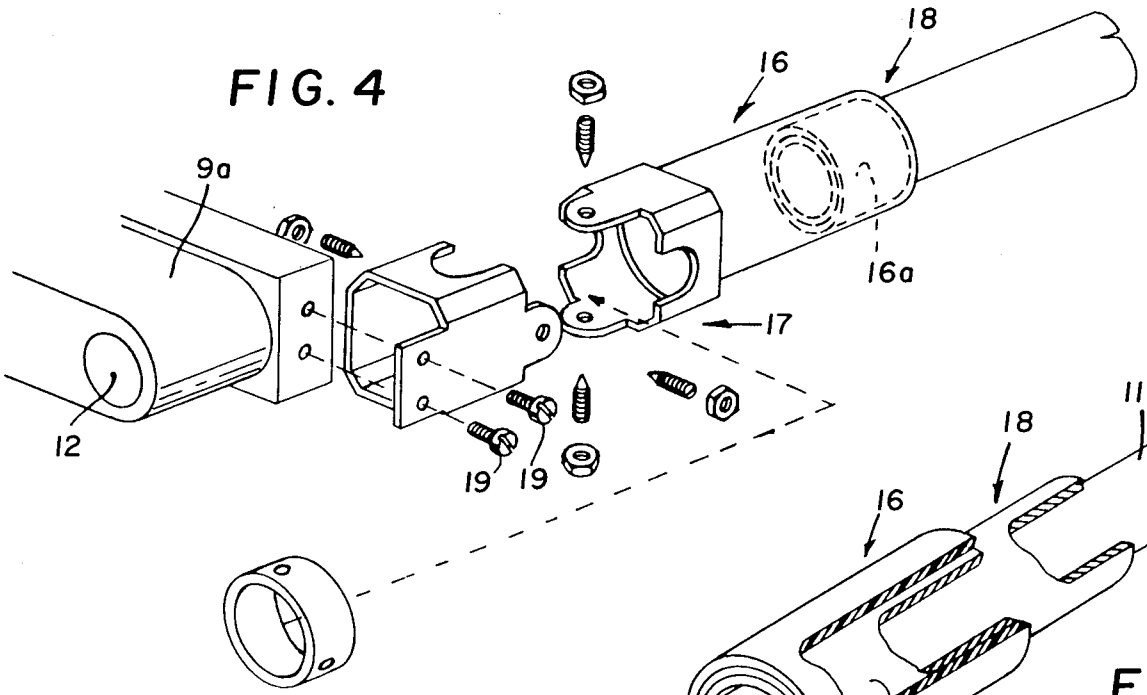
FIG. 4 is an exploded perspective view of the sleeve shown in FIG. 3.

With reference to the figures mentioned, the sewing machine according to the present invention is indicated in its entirety by the reference number 1.

In a manner known per se, the sewing machine 1 comprises two sewing groups 2 located alongside each other and separated by a gap 3 inside which a semifinished article, for example an article of clothing or similar object, can be arranged during sewing.

Again in a manner known per se, each sewing group 2 is operated by an upper shaft 4 leading to the respective head-piece 5 inside which the mechanisms for actuating a needle 2*a* are arranged. Sewing groups 2 have, in addition to the needles 2*a*, operatively opposed lower loopers and fabric feed devices which are contained within the respective machine bed and are operated by a lower shaft 6 of their own.

The upper shaft 4 and lower shaft 6 are connected to respective pulleys which are made to rotate simultaneously by a belt 7, in particular a toothed belt, tensioned by an idler wheel 8. The belt 7 is arranged on opposite columns 9 of the machine 1.

The movement of all the components of the machine 1 is produced by a motor (not shown) which, via a drive belt 10, causes the lower shaft 6 and the belt 7 to rotate, as shown in FIG. 1.

According to the invention, the movement of the belt 7, directly adjacent to the drive belt 10, is transmitted to the belt 7 provided on the other column 9, via a drive shaft 11 located outside the machine 1.

In fact, each column 9 is advantageously provided with a boss or projection 9*a* inside which a hub 12 is rotatably inserted so that it is parallel and adjacent to the upper shaft 4 and also made to rotate by the toothed belt 7, via an associated pulley. Each hub 12 lies next to the respective column 9 and forms a continuation of the drive shaft 11.

Advantageously, each hub 12 is detachably fixed to the drive shaft 11, via simple screws. In fact, the sewing machine 1 is made from two single sewing machines 1*a*, 1*b*, which are completely conventional if considered separately, except for the presence of the hubs 12 and the bosses 9*a*.

In fact, the sewing machines 1*a*, 1*b*, are sewing machines which are known per se and simply placed opposite each other, the only special measure being to provide a left-hand machine and a right-hand machine. As is well known, in fact, conventional sewing machines are classified as right-hand machines and left-hand machines, depending on whether the gap is located to the right or left of the needle from the point of view of an operator feeding the fabric towards the needle itself. It is quite obvious that, in practice, any operation may be performed either by right-hand machines or left-hand machines, but in order to prevent fabric piling up behind the columns of the sewing machines, rather than in the gap on one side of the needles, either right-hand sewing machines or left-hand sewing machines are made and generally used, depending on the stitches to be performed.

The structure of the drive shaft 11 is shown in FIGS. 2 to 5. It consists substantially of two half-shafts 11*a*, 11*b*, which are joined to each other by a sleeve expansion coupling and engaged with the respective hubs 12 by means of universal couplings 13. The universal couplings 13 are located in the vicinity of the opposite ends of the half-shafts 11*a*, 11*b*, while the sleeve expansion coupling is arranged centrally with respect to the drive shaft 11 and consists substantially of a hollow end of the half-shaft 11*a*, which end is shaped in the manner of a grooved sleeve, and of a correspondingly grooved end of the half-shaft 11*b*.

Therefore, the sleeve expansion coupling is formed without any elements other than the two half-shafts 11*a*, 11*b*.

FIG. 2 shows that the proper opposite ends of the drive shaft 11 and of the half-shafts 11*a*, 11*b*, consist of collars 14 inside which the hubs 12 are fixed by means of screws 15.

The drive shaft 11 is advantageously provided with a protection sleeve 16 which is very similar to the shaft 11, but is fixed in rotation. In fact, the sleeve 16 comprises universal couplings 17 located at the ends (FIGS. 3 and 4) and a central expansion coupling 18 (FIG. 4). The sleeve 16 is therefore able to follow precisely all the movements of the drive shaft 11. Moreover, the sleeve 16 is fixed to the columns 9 by means of simple screws 19 (FIGS. 3 and 4).

Figure 5:
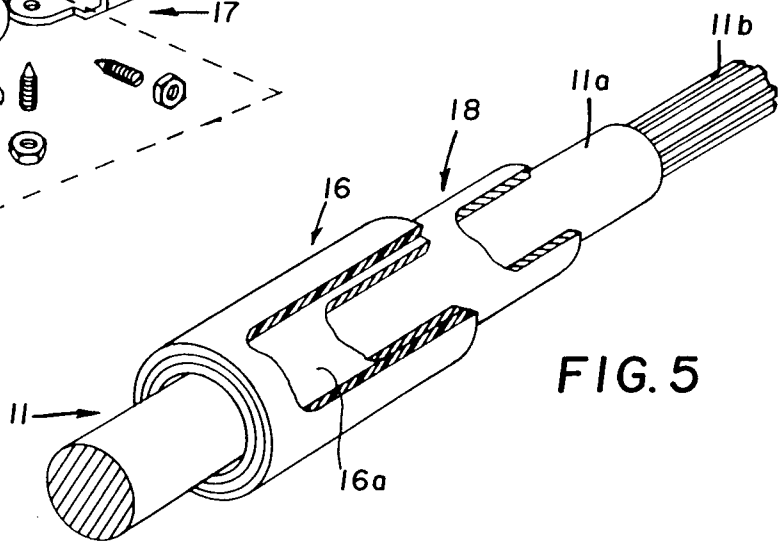
FIG. 5 shows a perspective section view of some of the elements arranged on the said drive shaft.

In order to prevent the sleeve 16 oscillating with respect to the drive shaft 11, tubular elements 16*a* with a low coefficient of friction, made for example from a plastic such as Teflon, are provided in the region of the central expansion coupling 18, as shown in FIG. 5.

Operation of the machine according to the invention is as follows.

When the drive shaft 11 is mounted, the machine 1 is able to operate with maximum precision, even if the two machines 1*a*, 1*b*, are mounted in a relatively imprecise manner with respect to each other, that is to say in such a way that they are not perfectly aligned. In fact, the drive shaft 11 and its sleeve 16 are able to compensate any shift in the mutual positions of the two machines. The latter can then be moved towards and away from each other even, if necessary, without interrupting the sewing operations. When it is not required to use a sewing machine of the type described, the machine 1 can be immediately and simply divided into two independent machines, one a right-hand type machine and the other a left-hand type machine.

The operations to be performed consist in simply unscrewing certain screws, in particular the screws 19 which fix one end of the sleeve 16 and the screws 15 which fix the drive shaft 11 to the hubs 12.

Once the drive shaft 11 together with its sleeve 16 have been removed, the individual sewing machines 1*a*, 1*b* differ from the conventional sewing machines normally produced, only on account of the presence of the bosses 9*a* and the hubs 12 located in the region of the columns 9.

The invention thus achieves the objects proposed.

It is emphasized that the sewing machine according to the invention can be formed from two conventional type sewing machines already available to a user and that the drive shaft formed is able to compensate for serious inaccuracies in the alignment. Such a drive shaft insures perfect synchronism of the upper and lower sewing components of the two single sewing machines.

Moreover, the machine, as designed, has a simple structure and a relatively low cost.

All of the details can be replaced by technically equivalent features.

In practice, the materials used, the shapes and the dimensions may be of any nature or magnitude, as required.

I claim:

1. In a sewing machine designed to perform stitches simultaneously on the opposite edges of a workpiece of the type with a gap between the needles where said workpiece is arranged during sewing, said machine consisting of two sewing machines located opposite and adjacent each other, one of the right-hand type and the other of the left-hand type, and an external drive shaft connecting said two machines so that one is driven by the other, wherein said drive shat is provided with a universal joint at each of its ends and a sleeve expansion coupling at its middle area, said drive shaft being detachably fixed, at its ends, to two hubs, rotatably mounted on columns of said two machines and arranged parallel to and alongside an upper shaft of said two machines.

2. A machine as defined in claim 1, wherein a protection sleeve is arranged on said drive shaft, which sleeve is similar to said drive shaft itself and has a universal coupling at each end thereof, an expansion coupling at its middle area, said protection sleeve being detachably fixed to fixed columns of the two said sewing machines.

3. A machine as defined in claim 2, wherein the said protective sleeve and the said drive shaft are detachably fixed, by means of screws, to the two said sewing machines.

4. A machine as defined in claim 1, wherein the said sleeve expansion coupling consists of two half-shaft portions which coaxially and adjustably penetrate each other and are grooved on the parts which mutually engage.

5. A machine as defined in claim 1, wherein the said hub on each said column is operated via a belt which also actuates the said upper shaft and lower shaft for operating lower sewing components.

6. A machine as defined in claim 1, wherein the said hub is inserted in a boss located on each of the said columns.

* * * * *